United States Patent [19]

Smith et al.

[11] Patent Number: 4,531,273

[45] Date of Patent: Jul. 30, 1985

[54] METHOD FOR FABRICATING GRAPHITE FILLED SINTERED METAL SEATS FOR BALL VALVES

[75] Inventors: Richard T. Smith, Ipswich, N.H.; Robert H. Osthues, Holden, Mass.

[73] Assignee: Worcester Controls Corporation, West Boylston, Mass.

[21] Appl. No.: 668,689

[22] Filed: Nov. 6, 1984

Related U.S. Application Data

[63] Continuation of Ser. No. 411,943, Aug. 26, 1982, abandoned.

[51] Int. Cl.[3] ..... B21D 53/00

[52] U.S. Cl. ..... 29/157.1 R; 29/149.5 PM; 29/156.7 A; 29/527.2; 29/527.4; 141/1; 251/315; 251/359; 251/368; 384/297; 419/27; 419/28; 427/331; 427/369; 427/372.2; 427/379; 427/435

[58] Field of Search ..... 29/156.7 A; 384/297

[56] References Cited

U.S. PATENT DOCUMENTS

| | | | |
|---|---|---|---|
| 1,464,569 | 8/1923 | Guptill | 29/149.5 PM |
| 1,930,277 | 10/1933 | Lenz et al. | 29/149.5 PM |
| 2,350,854 | 6/1944 | Whiteley | 29/149.5 PM |
| 2,372,202 | 3/1945 | Hensel et al. | 29/149.5 PM X |
| 2,661,238 | 1/1953 | Baliclei | 419/26 X |
| 2,788,324 | 4/1957 | Mitchell | 29/149.5 PM |
| 2,838,829 | 6/1958 | Goss et al. | 29/149.5 PM |
| 2,893,793 | 7/1959 | Ryshavy | 384/279 |
| 3,164,487 | 1/1965 | Macauly et al. | 427/372.2 X |
| 3,470,012 | 9/1969 | Rollette | 427/379 X |
| 3,592,440 | 7/1971 | McFarland | 29/157.1 R X |
| 3,608,170 | 9/1971 | Larson et al. | 29/149.5 PM |
| 3,790,352 | 2/1974 | Niimi et al. | 29/156.7 A |
| 3,818,564 | 6/1974 | Tsuya | 29/149.5 PM |
| 3,856,478 | 12/1974 | Iwata | 428/472 |
| 4,006,881 | 2/1977 | Gaillard | 251/368 |
| 4,205,420 | 6/1980 | Bothwell | 29/527.2 X |
| 4,269,391 | 5/1981 | Saito et al. | 251/368 |
| 4,290,581 | 9/1981 | Moran et al. | 251/368 |
| 4,377,892 | 3/1983 | Gonzalez | 29/157.1 R |
| 4,393,563 | 7/1983 | Smith | 29/149.5 PM X |

*Primary Examiner*—Howard N. Goldberg
*Assistant Examiner*—Ronald S. Wallace
*Attorney, Agent, or Firm*—Pollock, Vande Sande and Priddy

[57] ABSTRACT

A valve seat for ball valves comprises a ring-shaped or annular body fabricated of sintered metal particles having interparticulate spaces which are substantially completely filled with graphite. The seat is fabricated by pumping a dispersion of colloidal graphite in a liquid carrier through the matrix of a preformed ring-shaped sintered metal body, thereafter heating the body to drive off any portion of the liquid carrier which remains in the interparticulate spaces of the body, and then coining the body to collapse any voids which remain in the body and to mechanically bind into the body the graphite which has been trapped in said interparticulate spaces during the pumping step.

4 Claims, No Drawings

METHOD FOR FABRICATING GRAPHITE FILLED SINTERED METAL SEATS FOR BALL VALVES

This application is a continuation of application Ser. No. 444,943, filed Aug. 26, 1982, now abandoned.

BACKGROUND OF THE INVENTION

The present invention comprises an improvement on the invention described and claimed in copending Gonzalez U.S. Patent Application Ser. No. 214,904, filed Dec. 10, 1980, now U.S. Pat. No. 4,377,892, issued Mar. 29, 1983, for "Method of Fabricating Sintered Metal/-Polymer Impregnated Ball Valve Seats", assigned to the assignee of the instant application.

The aforementioned Gonzalez patent, the disclosure of which is incorporated herein by reference, describes a sintered metal seat fabricated of a compacted mass of particles of a corrosion resistant metallic alloy, e.g., stainless steel or bronze, whose pores or interparticulate spaces are impregnated with a polymeric material such as PTFE or TFE, describes the method of fabricating such seats, and discusses the advantages which such seats exhibit in valve applications intended to operate at comparatively high pressures. The seat is prepared by initially fabricating a sintered metal "green compact" structure in the form and shape conventionally employed for ball valve seats, thereafter sintering the green compact to fuse adjacent metal particles to each other, then impregnating the resultant seat with an emulsion of uncured polymeric material having lubricity, the impregnation being effected by means of a vacuum and/or positive pressure step, and then drying the resultant polymer impregnated seat whereafter the seat is placed in a furnace to sinter and cure the polymer which remains in the interparticulate spaces of the seat. Following these steps, the polymer impregnated seat is subjected to a coining step, i.e., extremely high pressures are applied to the exterior of the seat to collapse substantially all of the interparticulate cavities and voids throughout the seat onto the cured polymer which is enclosed within the seat, to eliminate all interparticulate voids in the sintered metal seat to the extent possible and to render the complete seat impervious to fluid flow, i.e., to make the final product "leak free" throughout.

Seats constructed in accordance with the foregoing procedure exhibit substantially uniform density throughout the body of the seat and at the exterior surfaces of the seat, and have been found in practice to hold bubble tight on helium, which is the most stringent leakage test available. The seats have a limited temperature capability, however, and it has been found that when seats of the Gonzalez type are operated at temperatures above 650° F. (the jell point of TFE), the TFE or other polymers impregnated into the seat begin to break down. Some of the polymer material vaporizes at these comparatively high temperatures, but other portions of the polymer simply extrude from the seat and adhere to and contaminate the ball of the valve with which the seat is associated.

There is need for a valve capable of operating at, for example, 1000° F. Such valves are commercially available at the present time, and typically employ seats fabricated of "Graphitar" (Trademark) produced by Wickes Engineered Materials Corp. This seat material is a slightly porous pure graphite sintered structure. Its major disadvantage is its brittleness, i.e., under severe thermal changes or shock loadings, the seat material fractures and the valve fails.

It is the object of the present invention to provide a seat which avoids the foregoing problems of the Gonzalez and Wickes seats and which, more particularly, can operate at temperatures up to 1000° F. and pressures up to 1000 psi by combining the high strength of the sintered metal matrix employed in the Gonzalez seat with the high temperature capability, anti-galling characteristics and good chemical inertness of graphite, to produce a valve seat having superior high temperature/-high pressure capabilities.

SUMMARY OF THE INVENTION

The valve seat of the present invention comprises a ring-shaped body of sintered powdered metal particles, i.e. particles of a corrosion resistant metallic alloy, the body having an annular surface adapted in use for engagement with the exterior of a rotary valve ball, and the interparticulate spaces of the sintered powdered metal body being completely filled with graphite.

The seat is fabricated by first forming a ring-shaped sintered powdered metal body having a configuration suitable for use in a rotary ball valve of generally known type, filling the interparticulate spaces of the ring-shaped sintered metal body with graphite by inducing a dispersion of colloidal graphite in a liquid carrier into said interparticulate spaces, by use of a vacuum and/or positive pressure, thereafter heating the metal body to drive off any portion of the liquid carrier which remains in said interparticulate spaces to leave behind a residue of graphite in said interparticulate spaces, and then coining the body by applying pressure to the exterior of the sintered metal body in a magnitude sufficiently high to collapse any voids which remain in the body after the filling step so as to mechanically bind the graphite into the ring-shaped metal body and to produce a composite metal/graphite valve seat having substantially no porosity and having substantially uniform density throughout.

In the preferred embodiment of the invention, the sintered metal body is preheated to accelerate the penetration of the colloidal graphite dispersion into the body, and the dispersion is preferably induced into the interparticulate spaces of the body by a succession of pumping steps which are interspersed respectively by heating steps operative to drive off portions of the liquid carrier which remain after each such pumping step. In addition, following the last pumping and heating step, and while the body is still heated, a coating of the same liquid dispersion is applied to the exterior of the graphite-filled body prior to the conducting of the coining step. It is believed that by use of this preferred procedure, the coining step drives the graphite portions of the surface coating into the body at the same time that voids within the body are collapsed to mechanically bind the graphite into the sintered metal matrix.

DESCRIPTION OF THE PREFERRED EMBODIMENTS

In fabricating a seat of the type contemplated by the present invention, a ring-shaped, filter density blank of sintered corrosion resistant metallic alloy powder particles is first formed, e.g., by a procedure of the type described in the aforementioned Gonzalez patent. A dispersion of graphite particles in emulsion form, i.e., in a liquid carrier, is then induced into the filter matrix using positive pressure and/or vacuum. With commercial dispersions, preheating of the seat accelerates this penetration. The seat is then heated to drive off the liquid carrier, whereafter a compression step, e.g., "coining" is applied to collapse the sintered metal structure, mechanically binding the graphite into the matrix and removing any remaining porosity. Seats produced by this technique show the same helium sealing capability as was exhibited by the polymerically impregnated seats of the Gonzalez patent, but are capable of operating at significantly higher temperatures than the Gonzalez seats.

The dispersion employed to fill the sintered powdered metal matrix preferably comprises graphite having a particle size of between $3\mu$ and $10\mu$, and such particles can be dispersed in emulsion form in any of a variety of liquid carriers. In the preferred embodiment of the invention, the material employed is "Aquadag", a dispersion of colloidal graphite in water available from Acheson Colloids Co., Port Huron, Michigan, and normally employed as an electrically conductive coating or as a lubricant for dyes, tools and molds utilized in metal working, glass making, etc. To facilitate the use of this material in the quite different application in which it is being employed in the present invention, the material is thinned, and then pumped under pressure through the preformed sintered powdered metal matrix, or through a stack of such preformed ring-shaped bodies, e.g., from the inner diameter to the outer diameter of each such body. To accelerate the penetration of the dispersion through the body, or through each such body in a stack, the body or bodies are preheated to a temperature of approximately 300° F., and following the pumping step the seat or seats are then heated again, e.g., to a temperature of between 280° F. and 300° F., to drive off any residual liquid carrier before the bodies are coined. The pumping step is, moreover, preferably one of a succession of such pumping steps, each of which is separated by a heating step to drive off liquid carrier remaining from the preceding pumping step. Following the last such pumping step, and while the sintered metal seat is still hot, the exterior of the seat, or at least that portion of the seat which is intended to be used as the sealing surface in a ball valve, is coated or "basted" with additional graphite material in emulsion form by brushing or spraying the dispersion onto the exterior of the seat.

Each seat is coined in a 200-ton press and, since the exterior area of each seat is roughly 2 $in^2$, the actual coining pressure is in the order of 100 tons/$in^2$. This extremely high pressure removes any remaining porosity in the seat by collapsing the sintered metal structure, and mechanically binds the graphite into the matrix of the seat material. Tests of the resultant seat establish that the seat exhibits the same helium sealing capability as the Gonzalez polymerically impregnated seats at pressures as high as 1000 psi, but that the seats of the present invention can operate at significantly higher temperatures, e.g., 1000° F. without failure of the seat or of the ball valve in which it is employed.

While we have thus described preferred embodiments of the present invention, many variations will be apparent to those skilled in the art. It must therefore be understood that the foregoing description is intended to be illustrative only and not limitative of the present invention, and all such variations and modifications as are in accord with the principles described are meant to fall within the scope of the appended claims.

Having thus described our invention, we claim:

1. A method of making a ball valve seat operable at temperatures up to 1000° F. and pressures up to 1000 psi, comprising the steps of fabricating a ring-shaped metal body by compacting a mass of corrosion resistant powdered metal particles and thereafter sintering said compacted mass of powdered metal particles, the interior of said body having interparticulate spaces and the exterior of said body being shaped to define an annular surface adapted in use for engagement with the exterior of a rotary valve ball, pumping a dispersion of graphite particles in a liquid carrier through said ring-shaped metal body via the interparticulate spaces of said body and then drying said metal body to remove any portion of the liquid carrier which remains in said interparticulate spaces thereby to leave a residue in the interparticulate spaces of said ring-shaped sintered powdered metal body consisting essentially of dry graphite particles, and thereafter coining said body by applying pressure to the exterior of said sintered powdered metal body in a magnitude sufficiently high to collapse any voids which remain in said body after said drying step thereby to securely bind the dry graphite particles in said interparticulate spaces into said ring-shaped metal body and to produce a composite metal/graphite valve seat having substantially no porosity and having substantially uniform density throughout, said conining step being effected after said drying step without any intervening method step that would alter the physical nature of the dry graphite particle residue remaining in said interparticulate spaces after said drying step.

2. The method of claim 1 wherein said dispersion comprises graphite having a particle size between $3\mu$ and $10\mu$.

3. The method of claim 2 wherein said liquid carrier is water.

4. The method of claim 1 wherein said dispersion is a dispersion of colloidal graphite in water.

* * * * *